United States Patent [19]

Michny

[11] Patent Number: 5,020,331

[45] Date of Patent: Jun. 4, 1991

[54] REFRIGERANT RECLAMATION SYSTEM

[75] Inventor: Robert S. Michny, Morris, Pa.

[73] Assignee: National Refrigeration Products, Inc., Plymouth Meeting, Pa.

[21] Appl. No.: 478,814

[22] Filed: Feb. 9, 1990

[51] Int. Cl.[5] ..... F25B 45/00

[52] U.S. Cl. ..... 62/77; 62/149; 62/292

[58] Field of Search ..... 62/77, 149, 292

[56] References Cited

U.S. PATENT DOCUMENTS

| | | | |
|---|---|---|---|
| 3,232,070 | 2/1966 | Sparano | 62/292 X |
| 3,425,238 | 2/1969 | Sylvan | 62/507 |
| 4,170,116 | 10/1979 | Williams | 62/116 |
| 4,242,878 | 1/1981 | Brinkerhoff | 62/119 |
| 4,285,206 | 8/1981 | Koser | 62/292 X |
| 4,363,222 | 12/1982 | Cain | 62/292 |
| 4,476,688 | 10/1984 | Goddard | 62/292 X |
| 4,476,693 | 10/1984 | Johnson | 62/402 |
| 4,480,446 | 11/1984 | Margulefsky et al. | 62/474 |
| 4,513,578 | 4/1985 | Proctor et al. | 62/292 X |
| 4,550,573 | 11/1985 | Rannenberg | 62/172 |
| 4,566,291 | 1/1986 | Halavais | 62/402 |
| 4,584,838 | 4/1986 | AbuJudom II | 62/5 |
| 4,688,388 | 8/1987 | Lower et al. | 62/149 X |
| 4,766,733 | 8/1988 | Scuderi | 62/77 |
| 4,809,515 | 3/1989 | Houwink | 62/149 |
| 4,856,289 | 8/1989 | Lofland | 62/149 |
| 4,934,390 | 6/1990 | Sapp | 62/77 |
| 4,938,031 | 7/1990 | Manz et al. | 62/149 |

*Primary Examiner*—Lloyd L. King

*Attorney, Agent, or Firm*—Panitch Schwarze Jacobs & Nadel

[57] ABSTRACT

A refrigerant reclamation system for a refrigeration system having a refrigerant therein. The system includes a pump for removing refrigerant from the refrigeration system. The pump is driven by a pneumatic motor. The pump has a first mode of operation for removing refrigerant in a substantially liquid phase and a second mode of operation for removing refrigerant in a substantially gaseous phase. A refrigerant heat exchanger for cooling refrigerant passing therethrough is in fluid communication with the pump. A refrigerant recovery container is connected to the heat exchanger for receiving the cool refrigerant therefrom. A compressed gas drives the pneumatic motor so that the pump removes refrigerant from the refrigeration system and is passed through the heat exchanger. A pneumatic fan and manifold are connected to the exhaust of the pneumatic motor for dispersing the exhausted gas for impingement on the heat exchanger for cooling the refrigerant passing therethrough such that the exhaust gas from the pneumatic motor is used to assist in changing the phase of the refrigerant from gas to liquid.

15 Claims, 1 Drawing Sheet

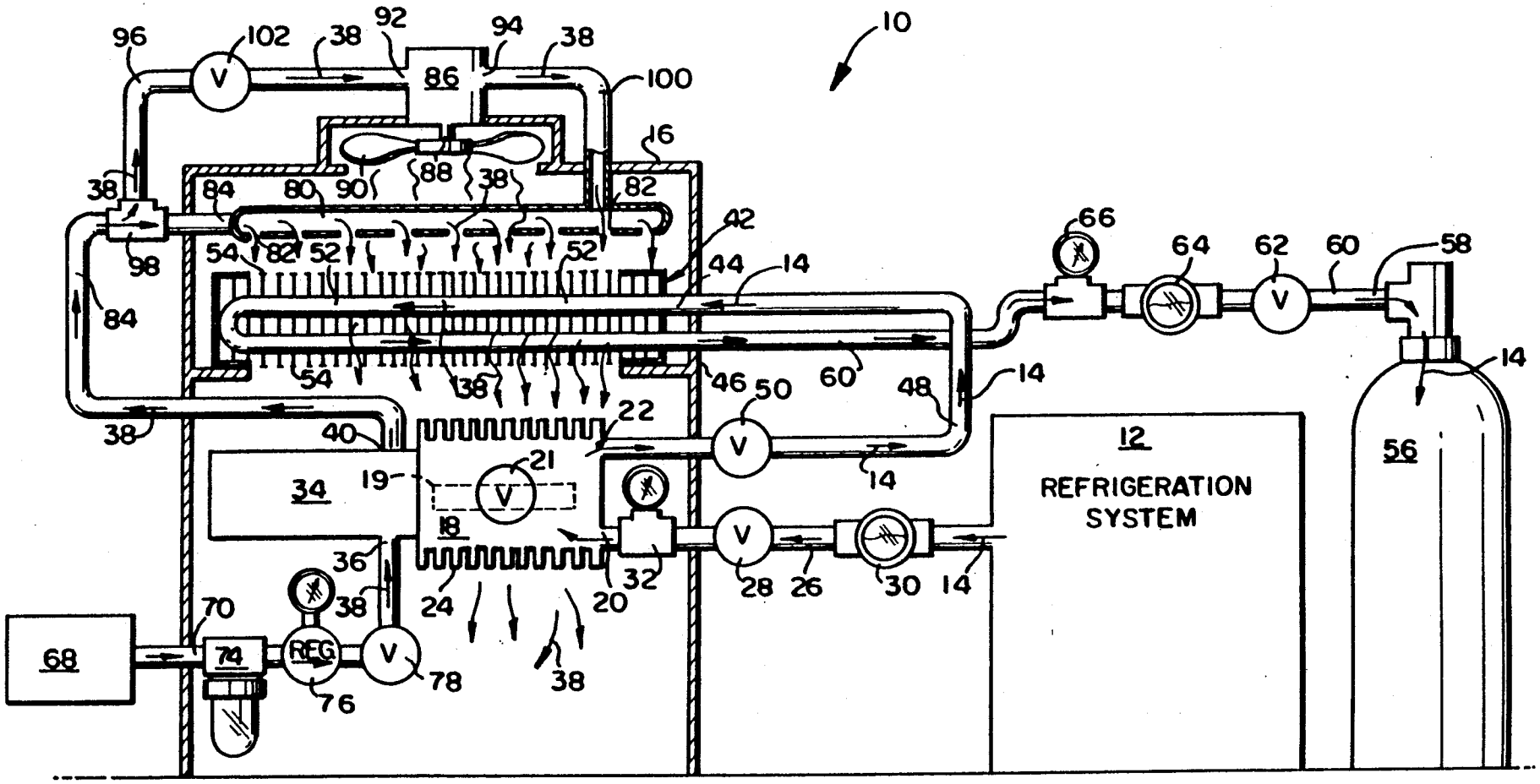
REFRIGERATION SYSTEM
12
REG

REFRIGERANT RECLAMATION SYSTEM

FIELD OF THE INVENTION

The present invention relates to an apparatus for servicing refrigeration systems of the type utilizing a compressible refrigerant as the cooling medium and, more particularly, to an apparatus for the reclamation of the refrigerant from the refrigeration system, wherein the refrigerant is precluded from escaping to the atmosphere.

BACKGROUND OF THE INVENTION

For many years, refrigerants which consist of chlorofluorocarbons (CFC), of which "FREON" is a well known commercial brand, have been the standard heat transfer media in refrigeration units, air conditioners, heat pumps, and the like. The reason for their widespread use is that CFC's are stable and non-flammatory, boil and condense in a useful temperature and pressure range, and were believed to be relatively inert and free of harmful side effects. However, it has been discovered that releasing CFC's into the atmosphere seriously impacts the ozone layer, and it is now necessary to avoid open air release of CFC's from equipment which contains them. In the normal use of refrigeration systems, the refrigerant is constantly recycled and is not released to the atmosphere. However, over time the refrigerant generally becomes contaminated in the equipment and looses its effectiveness. The common contaminants include water, air, compressor oil, hydrochloric acid, waxes, varnishes, and the like. Such contamination accelerates the rate of breakdown of the CFC, because it results in increases in compressor operating temperature. Moreover, prolonged operation at higher temperatures can cause compressor or compressor drive failure.

For many years, when a refrigeration system needed servicing, it was common practice in the industry simply to release the refrigerant to the atmosphere. That practice is no longer acceptable; nor is it responsible to abandon CFC-containing equipment because it would eventually leak out. It thus is becoming increasingly desirable to service CFC-containing units in a manner which prevents any loss to the atmosphere or the environment.

Presently, there is no easy, practical method for evacuating a charged refrigeration system of its refrigerant and storing it in a receiving container. This is primarily because of the nature of the refrigerant. Most refrigerants, (e.g., FREON) exist as a gas at room temperature and at atmospheric pressure. Within a pressurized refrigeration system at room temperature, the freon exists as both a liquid and a gas. If a direct connection were made from the refrigeration system to a receiving container, the gas would expand and the liquid would boil until enough gas would enter the receiving container to equalize the pressure in the receiving container and the refrigeration system. The net result would be that only a small amount of refrigerant would be transferred into the container.

Conventional recovery devices cool the recovered refrigerant indirectly by utilizing an evaporator coil in a sealed tank. The coolant in the evaporator coil (auxiliary refrigerant) is cooled by the standard refrigeration system. This creates a temperature difference between the auxiliary refrigerant in the coil and the refrigerant in the tank (e.g., the refrigerant to be recovered). As a result, the refrigerant in the tank is cooled, creating a pressure differential, and allowing the refrigerant from the coil to flow into the recovery tank.

Other refrigerant recovery systems utilize a pair of accumulators connected in line between a compressor and the refrigeration system to be evacuated. Still other systems involve diverting a portion of liquified gas to an evaporator coil which is in a heat exchange relationship with a condenser coil.

None of the known refrigerant reclamation systems successfully address the problem of transferring large quantities of liquid refrigerant from a large refrigeration system in an efficient and time saving manner. Typically, such known refrigerant reclamation systems remove the refrigerant from the refrigeration systems utilizing a pump which has a single mode of operation (i.e., the pumps typically do not include the ability to change their capacity or maximum pump rate). As such, the pump removes the refrigerant with the same mode of operation regardless of the phase of the refrigerant (i.e., liquid or gaseous). Typically, such pumps remove the refrigerant in its liquid phase at approximately 5 pounds per minute and remove the refrigerant in its gaseous phase at approximately ½ pound per minute. Thus, the prior art systems do not address the problem of removing refrigerant from the refrigeration system in both the liquid and gaseous phases.

Moreover, there exists a need for such a system which can efficiently and economically convert the phase of the refrigerant from gas to liquid. There further exists a need for a refrigerant reclamation system which is efficient and of such size as to be portable and readily utilized in the servicing of large refrigeration systems where electricity is not always available to power the system.

The present invention overcomes many of the disadvantages inherent in the conventional refrigerant reclamation systems by providing a pneumatically operated system, wherein a pneumatically operated pump has a first mode of operation for removing the refrigerant in a substantially liquid phase and a second mode of operation for removing the refrigerant in a substantial gaseous phase. Additionally, the refrigeration reclamation system of the present invention results in an efficient system for withdrawing refrigerants by utilizing the exhausted fluid from the pneumatic pump to cool the refrigerant to promote the condensation thereof. Thus, use of the present invention results in considerable savings in money as well as time for the removal of refrigeration system refrigerants.

SUMMARY OF THE INVENTION

Briefly stated, the present invention is a refrigerant reclamation system for a refrigeration system having refrigerant therein. The system includes a pump for removing the refrigerant from the refrigeration system. The pump has an inlet in fluid communication with the refrigerant in the refrigeration system and an outlet. The pump has a first mode of operation for removing the refrigerant from the refrigeration system in a substantially liquid phase and a second mode of operation for removing the refrigerant from the refrigeration system in a substantially gaseous phase. A pneumatic motor is provided for driving the pump. The motor has a gas inlet for receiving a compressed gas and a gas outlet. A refrigerant heat exchanger for cooling refrigerant passing therethrough has an inlet in fluid communication with the outlet of the pump and an outlet. A compressed gas supply is in fluid communication with the gas inlet of the pneumatic motor for driving the pneumatic motor to drive the pump so that refrigerant is removed from the refrigeration system and is passed through the heat exchanger. The present invention further includes gas dispersement means in fluid communication with the gas outlet of the pneumatic motor for dispersing gas exhausted from the gas outlet for impingement on the heat exchanger for cooling the refrigerant passing therethrough whereby the exhaust gas from the pneumatic motor is used to assist in cooling the refrigerant.

BRIEF DESCRIPTION OF THE DRAWING

The foregoing summary, as well as the following detailed description of the preferred embodiment, is better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing:

The FIGURE is a schematic elevational view, partially in cross section, of the refrigerant reclamation system in accordance with the present invention.

DESCRIPTION OF PREFERRED EMBODIMENT

Certain terminology is used in the following description for convenience only and is not limiting. The words "right," "left," "lower" and "upper" designate directions in the drawing to which reference is made. The words "inwardly" and "outwardly" refer to directions toward and away from, respectively, the geometric center of the refrigerant reclamation system and designated parts thereof. The terminology includes the words above specifically mentioned, derivatives thereof and words of similar import.

Referring now to the drawing in detail, there is shown in the FIGURE a preferred embodiment of a refrigeration reclamation system, generally designated 10, in accordance with the present invention. The refrigeration reclamation system 10 is preferably used in connection with a refrigeration system 12 (shown in functional schematic form) having a refrigerant, designated by the flow arrows 14, therein. The refrigerant 14 used in connection with the refrigeration system 12 is preferably of the high pressure type which exists as both a liquid and a gas within the pressurized refrigeration system at room temperature, such as "FREON", as discussed above. The present invention is not limited to any particular type of refrigerant 14 and can be used in connection with any high pressure refrigeration system, as is understood by those skilled in the art.

The refrigeration system 12 is schematically represented and typically constitutes a refrigeration system for food cooling or an air conditioning system such as used in vehicles, window units or central domestic and commercial units. The type or particulars of the refrigeration system 12 are not pertinent to the present invention and are understood by those skilled in the art. Accordingly, further description thereof is not believed to be necessary or is it limiting.

The refrigerant reclamation system 10 preferably includes a housing 16 for supporting the various elements which make up the refrigerant reclamation system 10. The housing 16 is preferably constructed of a high strength lightweight material, such as steel, and is preferably mounted on a frame (not shown) having wheels (not shown) rotatably mounted thereon such that the housing 16 and the various elements mounted thereon can be readily moved to a particular location in the field. It is understood by those skilled in the art, that the housing 16 can be secured to a permanent location and that the refrigeration system 12 can be transported to the permanent location for servicing. This may be desired where the user is in the business of servicing small air conditioning units (e.g., window units) which are more readily transported to the user's place of business for servicing.

As shown in the FIGURE, a pump 18 is provided for removing the refrigerant 14 from the refrigeration system 12. The pump 18 has an inlet 20 in fluid communication with the refrigerant 14 in the refrigeration system 12 and an outlet 22. As is understood by those skilled in the art, the pump 18 produces a vacuum effect in the inlet 20 for withdrawing the refrigerant 14 from the refrigeration system 12. Similarly, the pump 18 produces pressure at the outlet 22 for pumping or moving the refrigerant 14 through the remainder of the refrigerant reclamation system 10. The pump 18 preferably includes outwardly extending heat transfer fins 24 for dissipating heat created by the operation of the pump 18. Thus, the fins 24 help to cool the pump 18 and the refrigerant 14 flowing through the pump.

The inlet 20 of the pump 18 is in fluid communication with the refrigeration system 12 by a conduit 26 extending therebetween. It is preferred that the conduit 26 be connected to the refrigeration system 12 at a point where the refrigerant 14 is in a substantially liquid phase, for reasons which are apparent from the description hereinafter. The conduit 26 includes a manually actuated valve 28 for controlling the flow of refrigerant therethrough. A sight glass 30 and pressure gauge 32 are also incorporated in the conduit 26 for monitoring the flow of refrigerant 14 therethrough.

In the present embodiment, it is preferred that the pump 18 have a first mode of operation for removing the refrigerant 14 from the refrigeration system 12 in a substantially liquid phase and a second mode of operation for removing the refrigerant 14 from the refrigeration system 12 in a substantially gaseous phase. More particularly, it is preferred that the pump 18 be a double acting pump having a piston 19 which reciprocates in a forward and rearward direction, as is understood by those skilled in the art. Accordingly, when the pump 18 is in the first mode of operation, refrigerant 14 is removed from the refrigeration system only when the piston 19 moves in the forward direction and when the pump 18 is in the second mode of operation, refrigerant 14 is removed from the refrigeration system 12 when the piston 19 moves in both the forward and rearward directions. Alternatively, the piston 19 can remove refrigerant from the refrigeration system only when moving in the rearward direction in the first mode of operation, without departing from the spirit and scope of the invention.

Preferably, the pump 18 includes selection means for selecting either the first or second mode of operation. In the present embodiment, it is preferred that the selection means be comprised of a two-stage actuating valve 21 incorporated within the pump 18, as is understood by those skilled in the art. In use, the pump 18 can be switched between the first mode of operation and the second mode of operation by manually switching the two-stage actuating valve 21 between the first and second modes of operation as is also understood by those skilled in the art.

The pump 18, in accordance with the presently preferred invention, is an air amplifier-type pump which, as mentioned previously, is preferably double acting. The pump 18 preferably has a ratio of 5/1 and is driven by a pneumatic motor 34, described in more detail hereinafter. The pump 18 and pneumatic motor 34 are standard off-the-shelf items and are commercially available from Haskel, Inc. of Burbank, California as Model No. 54774.

A pneumatic motor 34 is provided for driving the pump 18. The pneumatic motor 34 has a gas inlet 36 for receiving compressed gas, generally designated by flow arrows 38, and a gas outlet 40.

While, in the present embodiment, it is preferred that the motor 34 and pump 18 be a standard single assembly off the shelf unit, it is understood by those skilled in the art, that other types of pumps and motors could be utilized so long as the pump has two different modes of operation for providing varying pump capacity, such as an electrically or hydraulically actuated pump. The specific internal configuration and elements of the pump 18 and motor 34, are within the knowledge of those of ordinary skill in the art and, therefore, for convenience only, further description thereof is neither believed to be necessary nor limiting.

Positioned within the housing 16 is a refrigerant heat exchanger 42 for cooling the refrigerant 14 passing therethrough. The heat exchanger 42 includes an inlet 44 in fluid communication with the outlet 22 of the pump 18 and an outlet 46. More particularly, the inlet 44 is connected to the outlet 22 of the pump 18 for fluid communication by a conduit 48 having a valve 50 for controlling the flow of refrigerant 14 therethrough. As shown in FIG. 1, the inlet 44 is preferably located at a higher elevation than the outlet 46 for assisting in the cooling of the refrigerant 14 and the flow of refrigerant 14 through the heat exchanger 42.

In the present embodiment, it is preferred that the heat exchanger 42 be comprised of the standard condenser type as is understood by those skilled in the art. That is, it is preferred that the heat exchanger 42 be comprised of a conduit 52 formed in a coil-like or loop-like manner with heat dissipating fins 54 extending outwardly therefrom. The heat exchanger 42 used in the present invention is of the type which is commercially available.

The refrigerant reclamation system 10 further includes a refrigerant recovery container 56 for storing the recovered refrigerant 14 in a liquid phase, as is understood by those skilled in the art. The container 56 has an inlet 58 in fluid communication with the heat exchanger outlet 46 for receiving cooled refrigerant 14 therefrom. In the present embodiment, it is preferred that the container 56 be in fluid communication with the heat exchanger outlet 46 by a conduit 60 interconnected therebetween. The conduit preferably includes a valve 62 for controlling the flow of refrigerant 14 between the container 56 and heat exchanger 42. Additionally, it is preferred that the conduit 60 include a sight glass 64 and a pressure gauge 66 for monitoring the flow of refrigerant 14 through the conduit 60 into the container 56.

As shown schematically in the lower left hand corner of the FIGURE, a compressed gas supply 68 is in fluid communication with the gas inlet 36 of the motor 34 for driving the motor 34 to drive the pump 18 so that the refrigerant 14 is removed from the refrigeration system 10 and is passed through the heat exchanger 42. The compressed gas supply 68 is preferably a standard portable air compressor having a motor which is powered by a liquid fuel, such as gasoline, to thereby obviate the use of electricity to power the system. A tank of compressed gas (not shown) could alternatively be employed. It is preferred that the gas used to drive the motor 34 be air, since it is readily available at almost all service sites. It is desired that the compressed gas supply 68 provide air which is compressed to at least 125 psig, which is sufficient pressure to drive the pneumatic motor 34 and pump 18.

Interposed between the gas inlet 36 of the motor 34 and the gas supply 68 is a conduit 70 for passing the compressed gas 38 therebetween. The conduit includes a filter 74 for removing particulate matter from the gas 38, as is understood by those skilled in the art. The conduit further includes a regulator valve 76 for regulating the pressure of the gas 38 passing to the motor 34 and a valve 78 for controlling the flow of the compressed gas 38 to the motor 34.

It is understood by those skilled in the art, that the gas supply 68 could also be in direct fluid communication with the pump 18 to thereby assist in driving the pump 18. It is also understood by those skilled in the art, that when the reclamation system 10 is used at a permanent site, the compressed gas supply 68 could also be from a permanent source and that other gases aside from air, such as nitrogen, could be used to power the pneumatic motor 34, without departing from the spirit and scope of the invention.

The reclamation system 10 includes gas dispersement means in fluid communication with the gas outlet 40 of the motor 34 for dispersing the gas 38 exhausted from the gas outlet 40 for impingement on the heat exchanger 42. The exhaust gas 38 from the motor 34 is used to cool the refrigerant 14 passing through the heat exchanger 42 and to assist in changing the phase of the refrigerant 14 from gas to liquid. In the present embodiment, it is preferred that the dispersement means comprise a manifold 80 positioned proximate the heat exchanger 42 in fluid communication with the gas outlet 40 for generally evenly dispersing the gas 38 for impingement on the heat exchanger 42. The manifold 80 is preferably of the same length as the heat exchanger 42 and includes a plurality of generally evenly spaced apertures 82 therein for dispersing the gas 38 evenly over the heat exchanger 42. The manifold 80 preferably communicates with the gas outlet 40 by the conduit 84 connected therebetween.

In the present embodiment, it is preferred that the apertures 82 be comprised of ⅛ inch nozzles equidistantly spaced across the length of the manifold 80 for spraying the gas 38 to thereby impinge upon the heat exchanger 42 which is cooled due to convection principles, as is understood by those skilled in the art. In addition, the manifold 80 further serves to muffle the sound of the driving pneumatic motor 34.

It is understood by those skilled in the art, that while the manifold 80 and heat exchanger 42 are schematically shown as being positioned within the housing 16 as separate units, they may be formed together as a single unit for ease of assembling the reclamation system 10.

In the present embodiment, it is preferred that the dispersement means further include a fan means in fluid communication with the gas outlet 40 and positioned proximate the heat exchanger 42 and the manifold 80 for promoting the flow of the gas 38 dispersed from the manifold 80 for impingement on the heat exchanger 42. In the preferred embodiment, the fan means comprises a second pneumatic motor 86 for driving a shaft 88 having fan blades 90 fixedly mounted thereon, as is understood by those skilled in the art. The second motor 86 preferably includes a gas inlet 92 in fluid communication with the gas outlet 40 of motor 34 and a gas outlet 94 in fluid communication with the manifold 80, such that the manifold 80 and the second motor 86 are connected in parallel.

The second motor 86 is preferably mounted at the top 87 of the housing 16 for forcing the gas 38 downwardly. It is desired that the housing 16 include apertures (not shown) extending through the top 87 of the housing for providing the fan blades 90 with a source of air.

The second motor 86 is in fluid communication with the gas outlet 40 by a conduit 96 extending therefrom to a "T" connection 98 in the conduit 84, such that gas 38 passing through the conduit 84 separates at the "T" connection 98 and flows to both the second motor 86 to thereby drive the shaft 88 and to the manifold 80 to be dispersed and impinged upon the heat exchanger 42. The gas outlet 94 of the second motor 86 is in fluid communication with manifold 80 by conduit 100 extending therebetween, such that the exhaust from the second motor 86 also impinges upon the heat exchanger 42.

A valve means is preferably interconnected between the second motor gas inlet 92 and the gas outlet 40 of the motor 34 for controlling the flow of gas 38 to the gas inlet 92 of the second motor 86. In the present embodiment, it is preferred that the valve means be comprised of a manual valve 102 located between the gas inlet 92 of the second motor 86 and the "T" connection 98 in fluid communication with the conduit 96 for controlling the flow of gas 38 therethrough, as is understood by those skilled in the art. Thus, the actuation of the second motor 86 is controlled by the valve 102.

It is understood by those skilled in the art, that other means can be utilized for driving the shaft 88 and fan blades 90 thereon, such as an electric motor (not shown), without departing from the spirit and scope of the invention.

As shown in the FIGURE, it is preferred that the dispersement means, pump 18 and heat exchanger 42 be positioned proximate each other so that the gas 38 exhausted from the dispersement means also impinges upon the pump 18 to cool the pump 18 and thereby further assist in cooling the refrigerant 14.

It is understood by those skilled in the art, that the various components, such as the valves, pressure gauges, sight glasses, filter and the like are standard off the shelf items which are interconnected in a manner which is understood by the ordinarily skilled artisan. In the present embodiment, it is preferred that the various conduits of the reclamation system 10 be flexible standard off the shelf items for easy interconnection of the various elements of the system, as is also understood by those skilled in the art. For convenience only, further description thereof is not believed to be necessary and, therefore, is not limiting.

In use, the gas supply 68 is first connected to the motor 34 by connecting the conduit 70 to the gas inlet 36 with the valve 78 in the closed position. The conduit 84 is then connected to the gas outlet 40 of the motor 34, the manifold 80 and the second motor 86. With the valve 78 in the closed position, the compressed gas supply 68 is then actuated so that when the valve 78 is turned to the open position, the compressed gas 38 is supplied to the motor 34.

The reclamation system 10 is then connected to the refrigeration system 12. The conduit 26 is interconnected between inlet 20 of the pump 18 and a part (not shown) of the refrigeration system 12 where the refrigerant 14 exists in a substantially liquid phase, with the valve 28 in the closed position. The conduit 48 is then interconnected between the outlet 22 of the pump 18 and the inlet 44 of the heat exchanger 42 with the valve 50 in the closed position. The conduit 60 is then interconnected between the inlet 58 of the container 56 and the outlet 46 of the heat exchanger 42 with the valve 62 in the closed position.

Before the reclamation system 10 is actuated, the valve 21 is placed in a position such that the pump 18 is in the first mode of operation because the conduit 26 is connected to the refrigeration system 12 where the refrigerant 14 is in a substantially liquid phase. Also, the valves 50 and 62 are placed in the open position for allowing the refrigerant 14 to pass therethrough. If desired, the valve 102 is also placed in the open position so that the gas 38 exhausted from the motor 34 actuates the second motor 86.

With the reclamation system 10 now ready for operation, the valve 28 is placed in the open position so that the pump 18 is in fluid communication with the refrigerant 14. The valve 78 is then opened and the compressed gas 38 begins to drive the motor 34 for driving the pump 18. The pump 18, being in the first mode of operation, begins removing refrigerant 14 from the refrigeration system 12 in its substantially liquid phase.

The user then monitors the refrigerant 14 passing through the conduit 26 by using the sight glass 30. When it appears that the pump 18 is no longer removing refrigerant 14 in the substantially liquid phase, but in the gaseous phase, the pump 18 is manually changed over to the second mode of operation through the valve 21.

Simultaneously, when the valve 78 is placed in the open position, the compressed gas 38 is exhausted from the motor 34 and dispersed by the manifold 80 for impingement upon the heat exchanger 42 to condense or cool the refrigerant 14 passing therethrough. Additionally, the exhausted gas 38 drives the second motor 86 and the fan blades 90 to further promote the impingement of the gas 38 with the heat exchanger 42. This is particularly important when the motor 34 is in the second mode of operation to cool the refrigerant 14 flowing into the container 56, so that it is in a substantially liquid phase.

The reclamation system 10 of the present embodiment, can remove large quantities of refrigerant 14 from the refrigeration system 12 because it operates in two modes. In the first mode, the refrigerant 14 is in a substantially liquid phase and the pump 18 only removes refrigerant 14 as the piston 19 moves in the forward direction (or alternatively in the rearward direction). The pump 18 is not used to remove liquid refrigerant when it is in the second mode of operation because it requires additional power to move the higher volume of liquid which in turn slows down the system and is hard on the motor 34. However, even with the pump 18 operating in the first mode, it is able to remove from 20–30 pounds per minute of substantially liquid refrigerant 14.

The pump 18 operates in the second mode to remove the refrigerant 14 in its gaseous phase, so that a larger capacity of gaseous refrigerant 14 is removed over time (e.g., 5 pounds per minute) without the necessity of extra power, thereby resulting in a reclamation system 10 which can quickly transfer large quantities of refrigerant 14. Moreover, by removing a high volume of the refrigerant 14 in its substantially gaseous phase, the reclamation system 10 is particularly successful in removing almost all of the refrigerant 14 from the refrigeration system, thereby promoting environmental safety.

In the present embodiment, it understood by those skilled in the art, that a manifold type system (not shown) can be interconnected between the conduit 60 and a plurality of containers 56 for allowing the refrigerant 14 to flow to a first selected container so that after the first container is filled, the system can be switched to a second container without having to shut down the motor 34. As the second container is being filled with refrigerant 14, a new or empty container can be installed where the first selected container was, to continue the cycle.

While it is preferred that the abovedescribed embodiment of the invention be used in connection with a high pressure refrigeration system, it is understood by those skilled in the art, that the present invention is equally applicable to low pressure refrigeration systems which use low pressure refrigerants, such as R11, R113.

From the foregoing description, it can be seen that the present invention comprises a refrigerant reclamation system. It is recognized by those skilled in the art, that changes may be made to the above-described embodiment of the invention without departing from the broad inventive concept thereof. It is understood, therefore, that this invention is not limited to the particular embodiment disclosed, but is intended to cover all modifications which are within the spirit and scope of the invention, as defined by the appended claims.

I claim:

1. A refrigerant reclamation system for a refrigeration system having a refrigerant therein, the system comprising:

a pump for removing refrigerant from the refrigeration system, the pump having an inlet in fluid communication with the refrigerant in the refrigeration system and an outlet;

a pneumatic motor for driving the pump, the motor having a gas inlet for receiving compressed gas and a gas outlet;

a refrigerant heat exchanger for cooling refrigerant passing therethrough, the heat exchanger having an inlet in fluid communication with the outlet of the pump and an outlet;

a compressed gas supply in fluid communication with the gas inlet of the pneumatic motor for driving the pneumatic motor to drive the pump so that refrigerant is removed from the refrigeration system and is passed through the heat exchanger; and gas dispersement means in fluid communication with the gas outlet of the pneumatic motor for dispersing gas exhausted from the gas outlet for impingement on the heat exchanger for cooling the refrigerant passing therethrough whereby the exhaust gas from the pneumatic motor is used to assist in changing the phase of the refrigerant from gas to liquid.

2. The refrigerant reclamation system of claim 1, whereby the dispersement means comprises a manifold positioned proximate the heat exchanger in fluid communication with the gas outlet for generally evenly dispersing the gas exhausted from the pneumatic motor for impingement on the heat exchanger.

3. The refrigerant reclamation system as recited in claim 2, wherein the dispersement means further includes fan means in fluid communication with the gas outlet and positioned proximate the heat exchanger and the manifold for promoting the flow of the gas dispersed from the manifold for impingement on the heat exchanger.

4. The refrigerant reclamation system as recited in claim 3, whereby the fan means comprises a second pneumatic motor for driving a shaft having fan blades mounted thereon, the second pneumatic motor having a gas inlet in fluid communication with the gas outlet of the pneumatic motor of the pump and a gas outlet in fluid communication with the manifold, whereby the manifold and the second pneumatic motor are connected in parallel.

5. The refrigerant reclamation system as recited in claim 4, further including valve means interconnected between the second pneumatic motor gas inlet and the gas outlet of the pneumatic motor of the pump for controlling the flow of gas to the gas inlet of the second pneumatic motor.

6. The refrigerant reclamation system as recited in claim 1, wherein the dispersement means, pump and heat exchanger are positioned proximate each other so that gas exhausted from the dispersement means also impinges upon the pump to cool the pump and thereby further assist in cooling the refrigerant.

7. The refrigerant reclamation system as recited in claim 1, further including a refrigerant recovery container for storing the refrigerant in a liquid phase, the container having an inlet in fluid communication with the heat exchanger outlet for receiving cooled refrigerant therefrom.

8. The refrigerant reclamation system as recited in claim 1, wherein the pump has a first mode of operation for removing the refrigerant from the refrigeration system in a substantially liquid phase and second mode of operation for removing the refrigerant from the refrigeration system in a substantially gaseous phase.

9. A refrigeration reclamation system for a refrigeration system having a refrigerant therein, the system comprising:

a pump for removing refrigerant from the refrigeration system, the pump having an inlet in fluid communication with the refrigerant in the refrigeration system and an outlet, the pump having a first mode of operation for removing the refrigerant from the refrigeration system in a substantially liquid phase and a second mode of operation for removing the refrigerant from the refrigeration system in a substantially gaseous phase;

a motor for driving the pump;

a refrigerant heat exchanger for cooling refrigerant passing therethrough, the heat exchanger having an inlet in fluid communication with the outlet of the pump and an outlet;

means for driving the motor to drive the pump so that refrigerant is removed from the refrigeration system and is passed through the heat exchanger.

10. The refrigerant reclamation system as recited in claim 9, wherein the pump is a double acting pump having a piston which reciprocates in a forward and rearward direction, such that when the pump is in the first mode of operation, the refrigerant is removed from the refrigeration system only when the piston moves in the forward direction and when the pump is in the second mode of operation, refrigerant is removed from the refrigeration system when the piston moves in the forward and rearward directions.

11. The refrigerant reclamation system as recited in claim 10, wherein in the pump further includes selection means for selecting either the first or second mode of operation.

12. The refrigerant reclamation system as recited in claim 9, wherein the motor is pneumatically driven.

13. A method of reclaiming refrigerant from a refrigeration system having a refrigerant therein, the method comprising the steps of:

removing refrigerant from the refrigeration system utilizing a pump driven by compressed gas;

passing the removed refrigerant through a heat exchanger for cooling the removed refrigerant; and routing gas exhausted from the pump for impingement upon the heat exchanger for cooling thereof.

14. The method as recited in claim 13, further including the step of:

routing a portion of the gas exhausted from the pump to a pneumatic fan for providing a flow of cooling gas for impingement upon the heat exchanger.

15. A method of removing a refrigerant from a refrigertion system containing a refrigerant which may be in either a liquid or a gaseous phase comprising the steps of:

connecting to the refrigeration system a pump capable of operating in two modes, a first mode in which refrigerant is removed from the refrigeration system only during a first portion of the cycle of the pump, and a second mode in which refrigerant is removed from the refrigeration system during both the first and a second portion of the cycle of the pump;

operating the pump in the first mode to remove refrigerant which is in a liquid phase; and operating the pump in the second mode to remove refrigerant which is in a gaseous phase.

* * * * *